US007059641B2

(12) United States Patent
Chanya

(10) Patent No.: US 7,059,641 B2
(45) Date of Patent: Jun. 13, 2006

(54) EXTERIOR DOOR HANDLE ASSEMBLY

(75) Inventor: Mark G. Chanya, Detroit, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/730,590

(22) Filed: Dec. 8, 2003

(65) Prior Publication Data

US 2005/0121924 A1 Jun. 9, 2005

(51) Int. Cl.
*E05B 3/00* (2006.01)

(52) U.S. Cl. ..... 292/336.3; 292/347

(58) Field of Classification Search ..... 292/336.3, 292/347, 348, DIG. 22, DIG. 4; 16/412
See application file for complete search history.

(56) References Cited

U.S. PATENT DOCUMENTS

| | | | | | |
|---|---|---|---|---|---|
| 4,510,779 | A * | 4/1985 | Ahad | 70/208 |
| 4,580,821 | A * | 4/1986 | Genord et al. | 292/336.3 |
| 4,588,219 | A * | 5/1986 | Kobayashi et al. | 292/336.3 |
| 4,652,030 | A * | 3/1987 | Streett | 292/336.3 |
| 4,653,143 | A * | 3/1987 | Ketelhut et al. | 292/336.3 |
| 4,778,207 | A * | 10/1988 | Gergoe | 292/336.3 |
| 4,907,833 | A * | 3/1990 | Ogasawara et al. | 292/336.3 |
| 6,141,914 | A * | 11/2000 | Feige et al. | 49/503 |
| 6,460,905 | B1 * | 10/2002 | Suss | 292/336.3 |
| 6,575,503 | B1 * | 6/2003 | Johansson et al. | 292/170 |
| 6,598,913 | B1 * | 7/2003 | Meinke | 292/336.3 |
| 6,843,084 | B1 * | 1/2005 | Porter | 70/208 |
| 6,923,481 | B1 * | 8/2005 | Bruderick et al. | 292/336.3 |
| 2002/0121786 | A1 * | 9/2002 | Meinke | 292/347 |

* cited by examiner

*Primary Examiner*—Gary Estremsky
(74) *Attorney, Agent, or Firm*—Laura C. Hargitt

(57) ABSTRACT

An exterior door handle assembly for a vehicle includes a handle housing operatively supported by a door of the vehicle and a door handle pivotally supported by the handle housing to be flush with an exterior surface of the door.

8 Claims, 4 Drawing Sheets

EXTERIOR DOOR HANDLE ASSEMBLY

TECHNICAL FIELD

The present invention relates generally to door handles and, more particularly, to an exterior door handle assembly for a vehicle.

BACKGROUND OF THE INVENTION

It is known that doors of a vehicle such as a motor vehicle use an exterior door handle to release and open the door. The door handle is typically attached to a release system that interconnects the door handle and a latch for the vehicle. Typically, the door handle extends outwardly from an exterior surface of the door and is pivotally connected thereto to allow an operator to rotate the door handle and actuate the release system to release the latch and open the door.

One disadvantage of the above-described exterior door handle is that the door handle is not flush with the exterior surface of the door. Another disadvantage of the above-described exterior door handle is that it produces wind noise.

As a result, it is desirable to provide an exterior door handle for a vehicle that does not extend outwardly from an exterior surface of the door. It is also desirable to provide an exterior door handle that reduces wind noise. It is further desirable to provide an exterior door handle that does not require any electronic device to assist it to open. Therefore, there is a need in the art to provide an exterior door handle assembly for a vehicle that meets these desires.

SUMMARY OF THE INVENTION

It is, therefore, one object of the present invention to provide a new exterior door handle assembly for a vehicle.

It is another object of the present invention to provide an exterior door handle assembly for a vehicle that is flush mounted to a door of the vehicle.

It is a further object of the present invention to provide an exterior door handle assembly for a vehicle that opens without the aid of any electronic device.

To achieve the foregoing objects, the present invention is an exterior door handle assembly for a vehicle. The exterior door handle assembly includes a handle housing operatively supported by a door of the vehicle and a door handle pivotally supported by the handle housing to be flush with an exterior surface of the door.

One advantage of the present invention is that an exterior door handle assembly is provided for a vehicle that is flush mounted to an exterior surface of a door and pops open to actuate the door handle. Another advantage of the present invention is that the exterior door handle assembly is flush mounted to an exterior surface of a door of a vehicle, resulting in clean styling. Yet another advantage of the present invention is that the exterior door handle assembly is flush mounted to an exterior surface of a door of a vehicle, resulting in reduced wind noise. Still another advantage of the present invention is that the exterior door handle assembly adapts to virtually any vehicle exterior surface across a large number of vehicle models. A further advantage of the present invention is that the exterior door handle assembly does not need any electronic device to assist it to pop open and set back to a flush position.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
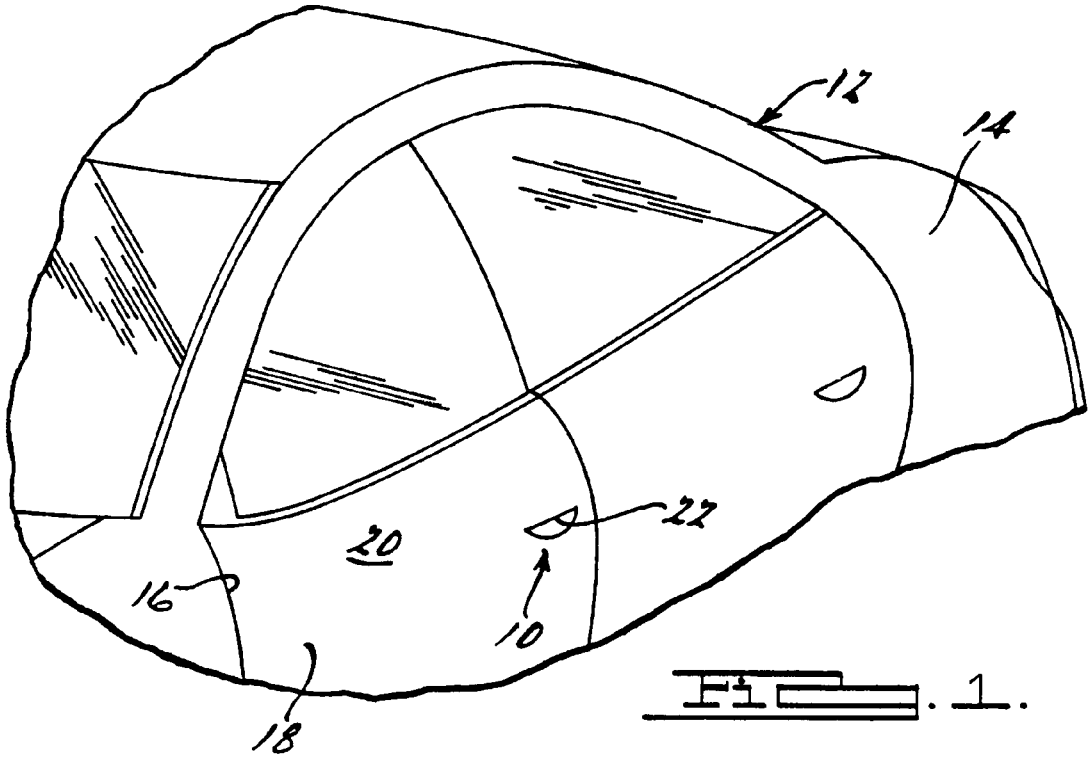
FIG. 1 is a perspective view of an exterior door handle assembly, according to the present invention, illustrated in operational relationship with a vehicle.

Referring to the drawings and in particular FIG. 1, one embodiment of an exterior door handle assembly 10, according to the present invention, is shown for a vehicle, partially shown and generally indicated at 12. The vehicle 12 includes a vehicle body 14 having an opening 16 and a door 18 hingedly connected at a forward end thereof to the vehicle body 14 to open and close the opening 16. The vehicle 12 also includes a latch (not shown) to latch and release the door 18 at a rear end thereof to the vehicle body 14. The vehicle 12 also includes a release system (not shown) having one end connected to the latch. The release system has another end connected to the exterior door handle assembly 10 to allow an operator (not shown) of the vehicle 12 to release the latch by operation of the exterior door handle assembly 10. The door 18 has an exterior surface 20 with an aperture 22 extending therethrough and the exterior door handle assembly 10 is disposed in the aperture 22 to be flush mounted to the exterior surface 20 in a manner to be described. It should be appreciated that, except for the exterior door handle assembly 10, the vehicle 12 is conventional and known in the art.

Figure 2:
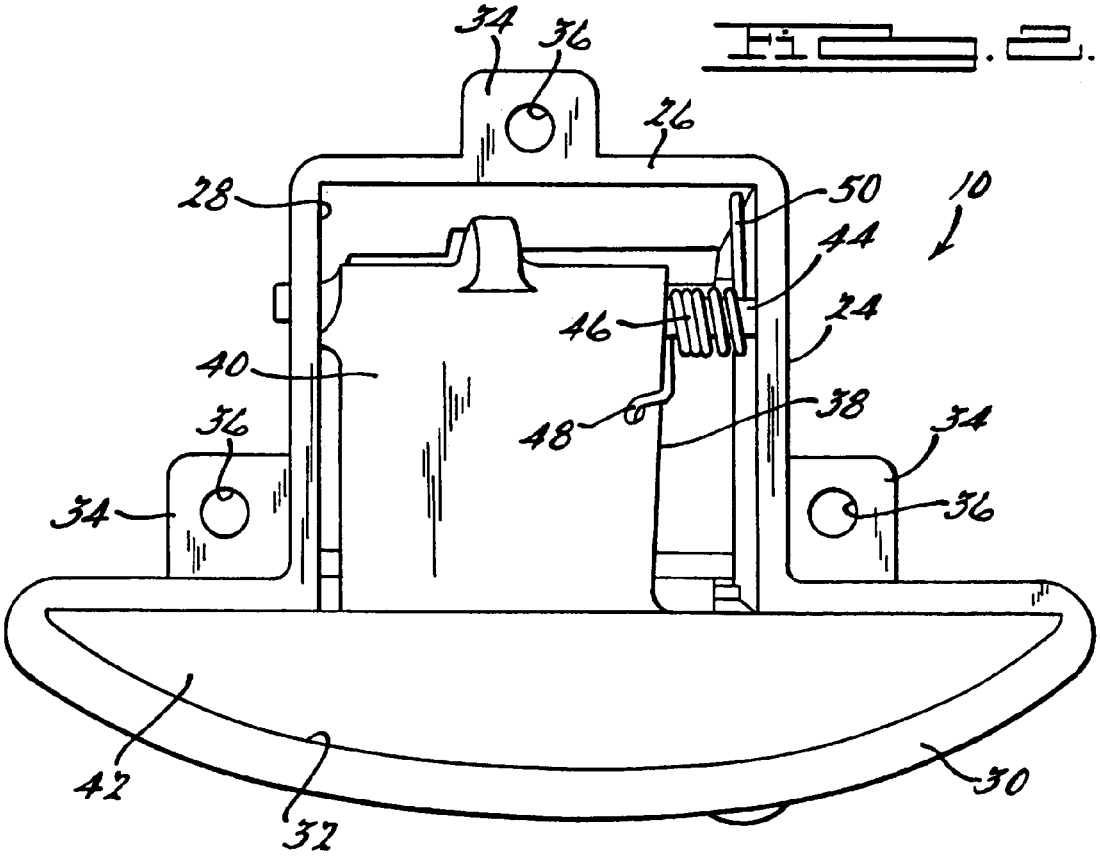
FIG. 2 is a front elevational view of the exterior door handle assembly of FIG. 1.
Figure 3:
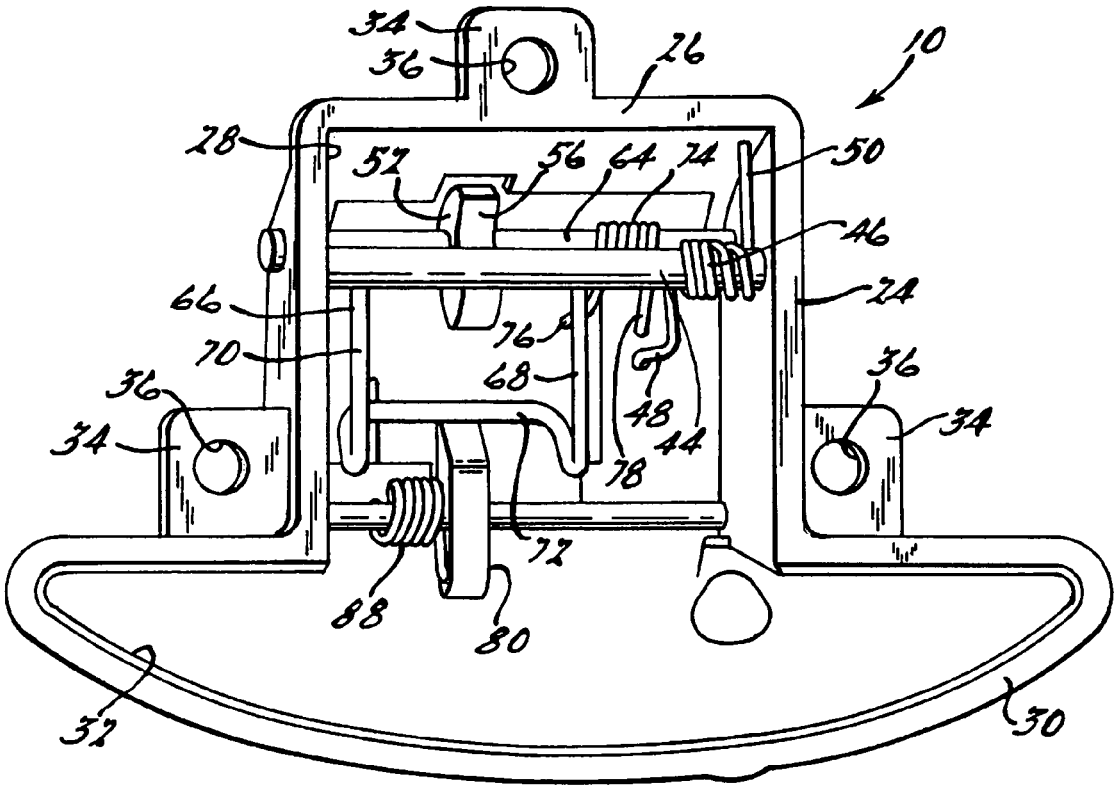
FIG. 3 is a rear elevational view of the exterior door handle assembly of FIG. 1 with a door handle removed.
Figure 4:
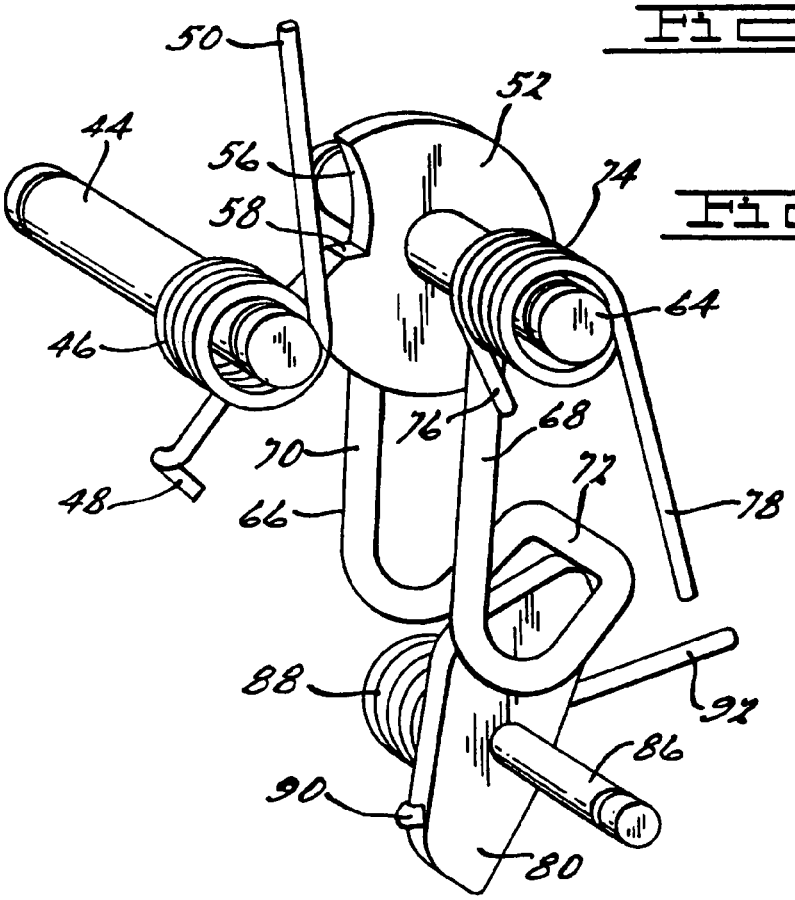
FIG. 4 is a perspective view of a portion of the exterior door handle assembly of FIG. 1.
Figure 5:
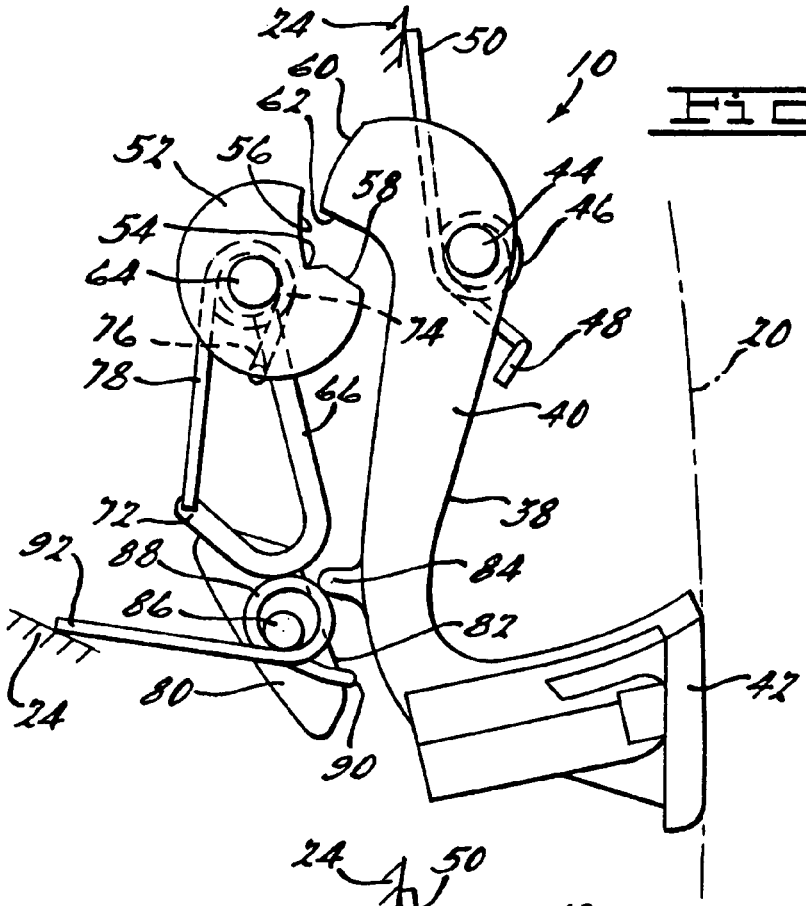
FIG. 5 is a fragmentary elevational view of the exterior door handle assembly of FIG. 1 illustrating a first step of operation.

Referring to FIGS. 2 through 4, the exterior door handle assembly 10 includes a handle housing 24 connected to the door 18. The handle housing 24 has a base portion 26 that is generally rectangular in shape. The base portion 26 has a cavity 28 therein. The handle housing 24 has an end portion 30 extending transversely to the base portion 26 at one end thereof. The end portion 30 has a width greater than a width of the base portion 26 such that the handle housing 34 has a generally "T" shape. The end portion 30 has a cavity 32 therein. The handle housing 24 has at least one, preferably a plurality of mounting tabs 34 extending from the base portion 26 and the end portion 30 and having an aperture 36 extending therethrough for mounting the handle housing 24 to the door 18 by suitable means such as fasteners (not shown). The handle housing 24 is made of a rigid material, preferably a plastic material. The handle housing 24 is a monolithic structure being integral, unitary, and one-piece. It should be appreciated that the handle housing 24 is disposed behind an outer panel of the door 18 and adjacent the aperture 22.

The exterior door handle assembly 10 also includes a door handle 38 disposed in the handle housing 24. The door handle 38 has a generally "T" shape. The door handle 38 has an arm portion 40 disposed in the cavity 28 of the base portion 26 of the handle housing 24. The arm portion 40 is generally rectangular in shape. The door handle 38 also has a handle portion 42 extending transversely at one end of the arm portion 40. The handle portion 42 has a width greater than a width of the arm portion 40. The handle portion 42 is disposed in the cavity 32 of the end portion 30 of the handle housing 24. The door handle 38 is made of a rigid material, preferably a plastic material. The door handle 38 is a monolithic structure being integral, unitary, and one-piece. It should be appreciated that the door handle 38 is disposed in the aperture 22 and flush with the exterior surface 20 of the door 18 such that door handle 38 does not extend outwardly beyond the exterior surface 20 of the door 18.

Referring to FIGS. 1 through 4, the exterior door handle assembly 10 includes a first rod 44 to pivotally connect the door handle 38 to the handle housing 24. The first rod 44 is generally cylindrical in shape and extends transversely through the arm portion 40 of the door handle 38 and the base portion 28 of the handle housing 24. The first rod 44 is made of a rigid material preferably a metal material. It should be appreciated that the door handle 38 rotates or pivots about the first rod 44 relative to the handle housing 24.

The exterior door handle assembly 10 also includes a first spring 46 to urge the door handle 38 toward the handle housing 24. The first spring 46 is of a torsional type disposed about the first rod 44 and having a first end 48 contacting the arm portion 40 of the door handle 38 and a second end 50 contacting the handle housing 24. The first spring 46 is made of a spring material such as spring steel.

The exterior door handle assembly 10 includes a first cam 52 cooperating with the door handle 38 to move the door handle 38 to an open position. The first cam 52 is generally circular in shape. The first cam 52 has a recess 54 with a generally "v" shape forming a first cam surface 56 and a second cam surface 58 for cooperating with a first follower surface 60 and a second follower surface 62, respectively, on the arm portion 44 of the door handle 38. The first cam 52 is made of a rigid material such as a metal material.

The exterior door handle assembly 10 includes a second rod 64 to pivotally connect the first cam 52 to the handle housing 24. The second rod 64 is generally cylindrical in shape and extends transversely through the first cam 52 and the base portion 28 of the handle housing 24. It should be appreciated that the first cam 52 rotates or pivots about the second rod 64 relative to the handle housing 24. It should be appreciated that the first cam 52 and second rod 64 may be made integral to rotate as one-piece.

The exterior door handle assembly 10 includes a bail 66 connected to the second rod 64 for cooperating with a second cam to be described. The bail 66 is generally "U" shaped and has a first end 68 extending through the second rod 64 on one side of the first cam 52 and a second end 70 spaced transversely from the first end 68 and extending through the second rod 64 on the other side of the first cam 52. The bail 66 has an inverted and generally "U" shaped middle portion 72 disposed between the first end 68 and the second end 70 for cooperating with the second cam. The bail 66 is made of a rigid material such as metal. The bail 66 is a monolithic structure being integral, unitary, and one-piece.

The exterior door handle assembly 10 also includes a second spring 74 to urge the first cam 52 toward the door handle 38. The second spring 74 is of a torsional type disposed about the second rod 46 and having a first end 76 contacting the first end 68 of the bail 66 and a second end 78 contacting the handle housing 24. The second spring 74 is made of a spring material such as spring steel.

The exterior door handle assembly 10 includes a second cam 80 cooperating with the door handle 38 to move the door handle 38 to a closed or stowed position. The second cam 80 is generally triangular in shape. The second cam 80 has a cam surface 82 for cooperating with a follower 84 extending from the arm portion 44 of the door handle 38. The second cam 80 is made of a rigid material such as a metal material.

The exterior door handle assembly 10 includes a third rod 86 to pivotally connect the second cam 80 to the handle housing 24. The third rod 86 is generally cylindrical in shape and extends transversely through the second cam 80 and the base portion 28 of the handle housing 24. It should be appreciated that the second cam 80 rotates or pivots about the third rod 86 relative to the handle housing 24.

The exterior door handle assembly 10 also includes a third spring 88 to urge the second cam 80 away from the door handle 38. The third spring 88 is of a torsional type disposed about the third rod 86 and having a first end 90 contacting the second cam 80 and a second end 92 contacting the handle housing 24. The third spring 88 is made of a spring material such as spring steel.

Figure 6:
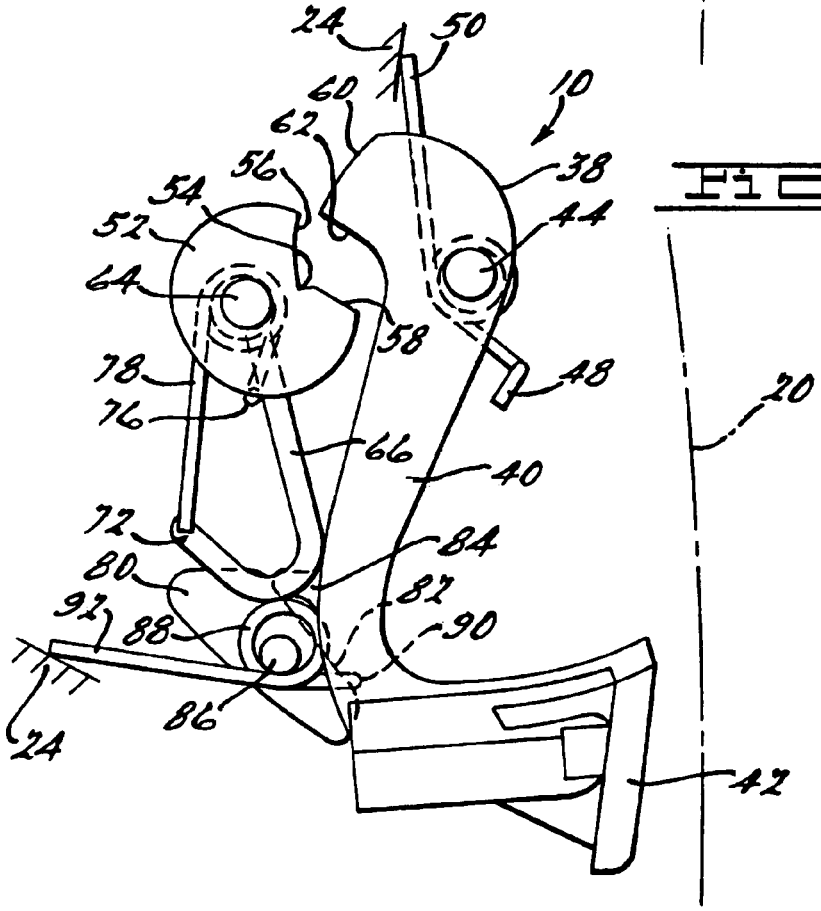
FIG. 6 is a fragmentary elevational view of the exterior door handle assembly of FIG. 1 illustrating a second step of operation.

Referring to FIGS. 5 through 8, the operation of the exterior door handle assembly 10 is illustrated. The door handle 38 is illustrated in a closed or stowed position in FIG. 5. In this position, the handle portion 42 is flush with the exterior surface 20 of the door 18. To open the door 18, the operator pushes the door handle 38 inwardly toward the handle housing 24. As the door handle 38 rotates about the first rod 44, the follower 84 moves along the cam surface 82 of the second cam 80 and causes the second cam 80 to rotate toward the door handle 38 against the force of the third spring 86. Simultaneously, the arm portion 44 disengages contact with the first cam 52 as illustrated in FIG. 6.

Figure 7:
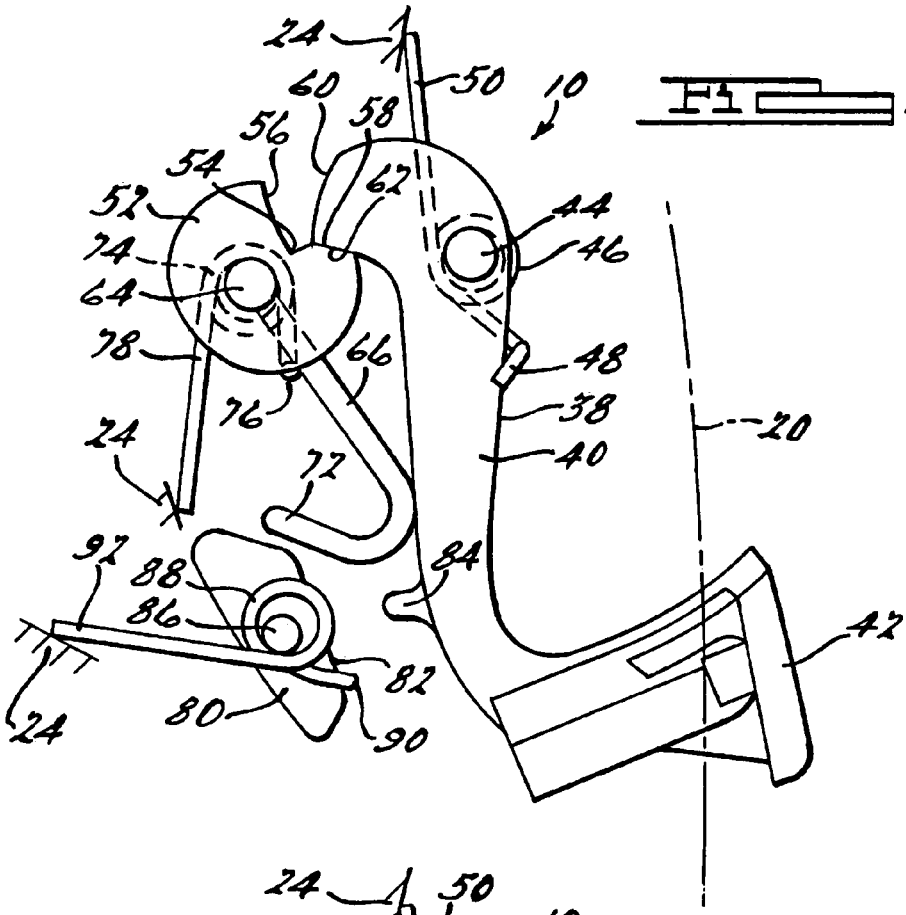
FIG. 7 is a fragmentary elevational view of the exterior door handle assembly of FIG. 1 illustrating a third step of operation.

Next, the operator releases the door handle 38. When this occurs, the bail 66 is forced by the second spring 74 toward the door handle 38 and moves the door handle 38 outwardly away from the handle housing 24. The second follower surface 62 engages the second cam surface 58 and the follower 84 disengages contact with the second cam 80 to allow the door handle 38 to pop-out to a first open position as illustrated in FIG. 7.

Figure 8:
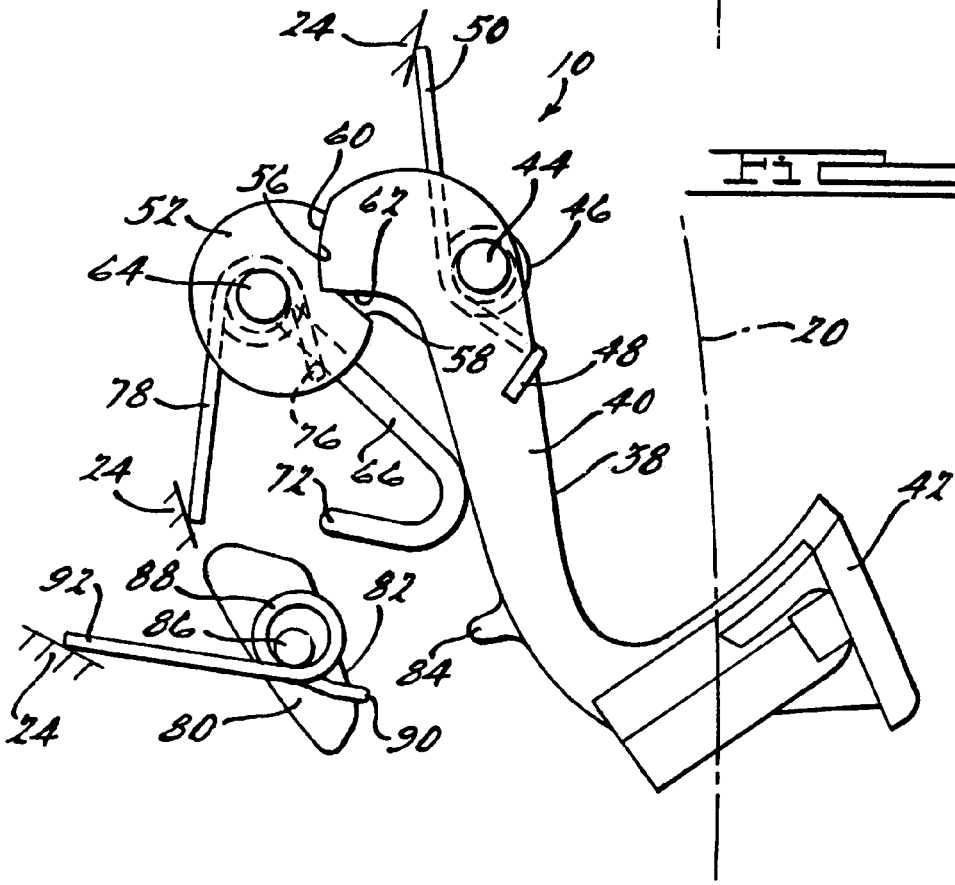
FIG. 8 is a fragmentary elevational view of the exterior door handle assembly of FIG. 1 illustrating a fourth step of operation.

Once the door handle 38 is popped open, the operator engages the handle portion 42 and lifts and pulls the handle portion 42 upwardly. When this occurs, the second follower surface 62 moves along the second cam surface 58 to rotate the first cam 52 and the first follower surface 60 contacts the first cam surface 56 as illustrated in FIG. 8. It should be appreciated that when the door handle 38 is lifted by the operator, the release system releases the latch mechanism and allows the operator to open the door 18.

To close the door handle 38, the operator releases the door handle 38. The first spring 46 moves the door handle 38 inwardly toward the handle housing 24 and the door handle 38 contacts the bail 66 to rotate the first cam 52. The second follower surface 62 moves along the second cam surface 58. The door handle 38 continues to move toward the handle housing 24 until the door handle 38 reaches the closed or stowed position of FIG. 5.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. An exterior door handle assembly comprising:

a handle housing operatively supported by a door of the vehicle;

a door handle pivotally suppdrted by said handle housing to be flush with an exterior surface of the door;

a cam pivotally supported by said handle housing and cooperating with an upper portion of said door handle;

a rod pivotally connecting said cam to said handle housing;

a bail connected to said rod and cooperating with said door handle; and a spring disposed about said rod and having one end contacting said bail and another end contacting said handle housing to urge said bail toward said door handle.

2. An exterior door handle assembly for a vehicle comprising:

a handle housing onerarivelv supported by a door of the vehicle:

a door handle pivotally supported by said handle housing to be flush with an exterior surface of the door;

at least one spring operatively cooperating with said handle housing and said door handle to allow an operator to push all of said door handle inwardly relative to the exterior surface of the door and to release said door handle thereby moving all of said door handle to a position outwardly relative to the exterior surface of the door;

a cam pivotally supported by said handle housing and cooperating with a lower portion of said door handle; and a rod pivotally connecting said earn to said handle housing;

wherein said at least one spring is disposed about said rod and has one end contacting said cain and another end contacting said handle housing to urge said cam toward said door handle.

3. An exterior door handle assembly as set forth in claim 2 wherein said cam has a cam surface and said door handle has a follower cooperating with said cam surface.

4. A door assembly comprising:

a door adapted to be hingedly connected to a vehicle and having an exterior surface with an aperture extending therethrough;

an exterior door handle assembly having a handle housing operatively supported by said door adjacent said aperture, a door handle pivotally supported by said handle housing to be flush with said exterior surface of said door, and a plurality of springs operatively cooperating with said handle housing and said door handle to allow an operator to push all of said door handle inwardly toward said handle housing and to release said door handle thereby moving all of said door handle away from said handle housing to a position outwardly from the exterior surface of said door; and a rod pivotally connecting said door handle to said handle housing;

wherein one of said springs is disposed about said rod and having one end contacting said door handle and another end contacting said handle housing to urge said door handle toward said handle housing.

5. A door assembly as set forth in claim 4 including a cam pivotally supported by said handle housing and cooperating with a lower portion of said door handle.

6. A door assembly as set forth in claim 5 including a rod pivotally connecting said cam to said handle housing.

7. A door assembly as set forth in claim 5 wherein said cam has a cam surface and said door handle has a follower cooperating with said cam surface.

8. A door assembly comprising:

a door adapted to be hingedly connected to a vehicle and having an exterior surface with an aperture extending therethrough; and an exterior door handle assembly having a handle housing operatively supported by said door adjacent said aperture and a door handle pivotally supported by said handle housing to be flush with said exterior surface of said door, a cam pivotally supported by said handle housing and cooperating with an upper portion of said door handle, a rod pivotally connecting said cam to said handle housing, a bail connected to said rod and cooperating with said door handle, and a spring disposed about said rod and having one end contacting said bail and another end contacting said handle housing to urge said bail toward said door handle.

* * * * *